US005332332A

United States Patent [19]

Kenyon, Jr.

[11] Patent Number: 5,332,332

[45] Date of Patent: Jul. 26, 1994

[54] RAIN GUTTER

[76] Inventor: Howard N. Kenyon, Jr., 12790 Rte. 144, West Friendship, Md. 21794

[21] Appl. No.: 924,968

[22] Filed: Aug. 5, 1992

[51] Int. Cl.[5] ..... E04D 13/06

[52] U.S. Cl. ..... 405/118; 52/11; 52/12; 405/119

[58] Field of Search ..... 405/118, 119, 121; 52/16, 11, 12

[56] References Cited

U.S. PATENT DOCUMENTS

| | | | |
|---|---|---|---|
| 546,042 | 9/1895 | Van Hoyn | 52/12 |
| 2,674,961 | 4/1954 | Lake | 52/12 X |
| 2,935,954 | 5/1960 | Matthews et al. | 52/12 X |
| 4,590,716 | 5/1986 | Smith | 52/12 |
| 4,667,448 | 5/1987 | Smith | 52/12 |

FOREIGN PATENT DOCUMENTS

| | | | |
|---|---|---|---|
| 318698 | 12/1969 | Sweden | 52/12 |

*Primary Examiner*—Dennis L. Taylor
*Attorney, Agent, or Firm*—John T. Roberts

[57] ABSTRACT

A collector plate for attachment at the roof edge of a building which includes a strainer to prevent the debris from entering the gutter trough or pipe. The collector plate includes a collector plate, having a flat section to collect the rain from the roof, a arcuate section to direct the water into a vertical direction, a down lead section to accelerate the speed of the water, before it encounters the strainer, which separates the debris before the water enters the pipe.

7 Claims, 5 Drawing Sheets

RAIN GUTTER

CROSS-REFERENCE TO RELATED APPLICATION

This invention is not disclosed in any co-pending application for a patent or any issued patent.

BACKGROUND OF THE INVENTION

This invention is an improvement in the field of rain gutters in general and specifically to those which screen out the majority of the debris before it can enter, and eventually foul, the gutter trough or pipe.

There are three principal types of debris, and a successful design must prevent each type from entering the gutter trough. The first type is large debris, typically leaves. Leaves are perhaps the easiest to remove by screening, but also the most likely to clog the screen, rendering it ineffective. The second type of debris is nuts, such as acorns. These cause the worst problem in a rain gutter because they never degrade, remaining in the rain gutter for years. The third type of debris is the small debris, typically pine needles or the blossoms of deciduous trees in the spring. These are the most difficult to separate because they go through a fine mesh.

The prior art includes innumerable designs intended to accomplish this function, without degrading from the primary function of the rain gutter, conveying all of the rain into the drainage pipes and away from the foundation of the building. A third function, also addressed in the prior art, is to reduce the susceptibility of the rain gutter to damage from ice as the ice slides off the roof of the building.

One widely used system is covering the conventional gutter trough with a screen. This system has several practical limitations. The mesh of the screen can trap leaves on top of the screen and prevent much of the rain from entering the gutter trough, particularly during a heavy rain. The screens are attached after the gutter trough is installed and the attachments often become loosened after time as ice slides off the roof, dislodging the screen.

U.S. Pat. No. 5,016,404, to Briggs, discloses a gutter trough above which is a curved metal or plastic sheet 80. The apex of the sheet extends beyond the lip of the gutter trough. The rain enters the gutter trough through a small aperture on the reverse slope of the curved sheet. There is no strainer to prevent the smaller debris from entering the pipe 16, although the orientation of the parts will allow larger debris, such as leaves to simply fall to the earth.

U.S. Pat. No. 4,876,827, to Williams, has an elongated trough portion 14 extending from the trough up to the roof line and under the shingles. A "water shed" portion 19 has a vertical lower portion and a curved upper portion. Water from the roof slides over the curved portion and then down the vertical portion, which has apertures whose purpose is to allow the water but not debris to enter the gutter trough.

SUMMARY OF THE INVENTION

A collector plate for attachment at the roof edge of a building which includes a strainer to prevent the debris from entering the gutter trough or pipe. The collector plate includes a collector plate, having a flat section to collect the rain from the roof, a arcuate section to direct the water into a vertical direction, a down lead section to accelerate the speed of the water, before it encounters the strainer, which separates the debris before the water enters the pipe.

The invention accordingly comprises the several steps and the relation of one or more of such steps with respect to each of the others, and the apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

The invention will be better understood and the objects other than those set forth above will become apparent when consideration is given to the following detailed description thereof. Such description makes reference to the annexed drawings wherein.

DESCRIPTION OF THE PREFERRED EMBODIMENTS

Figure 1:
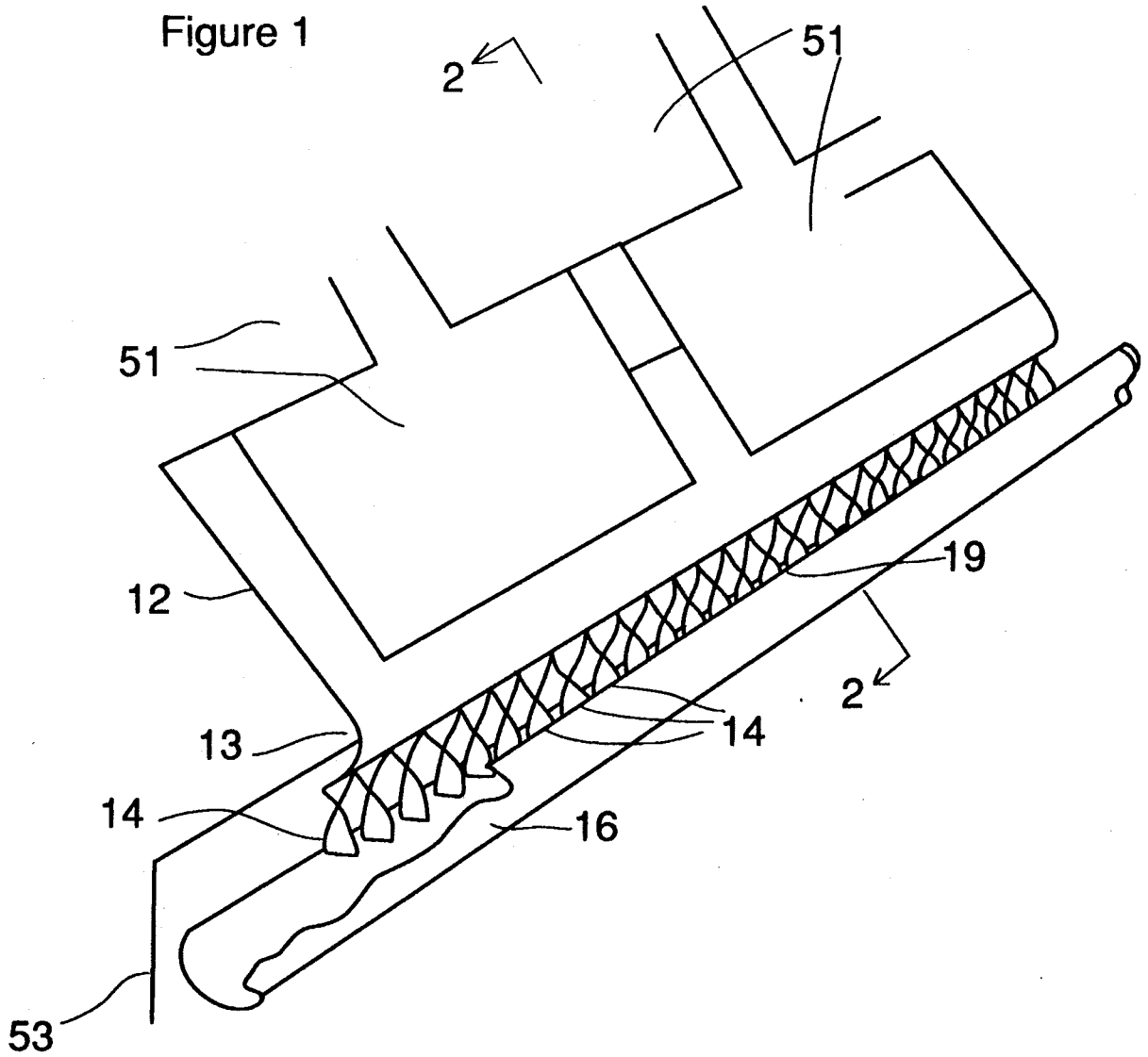
FIG. 1 is a perspective view of a first embodiment of my invention.
Figure 2:
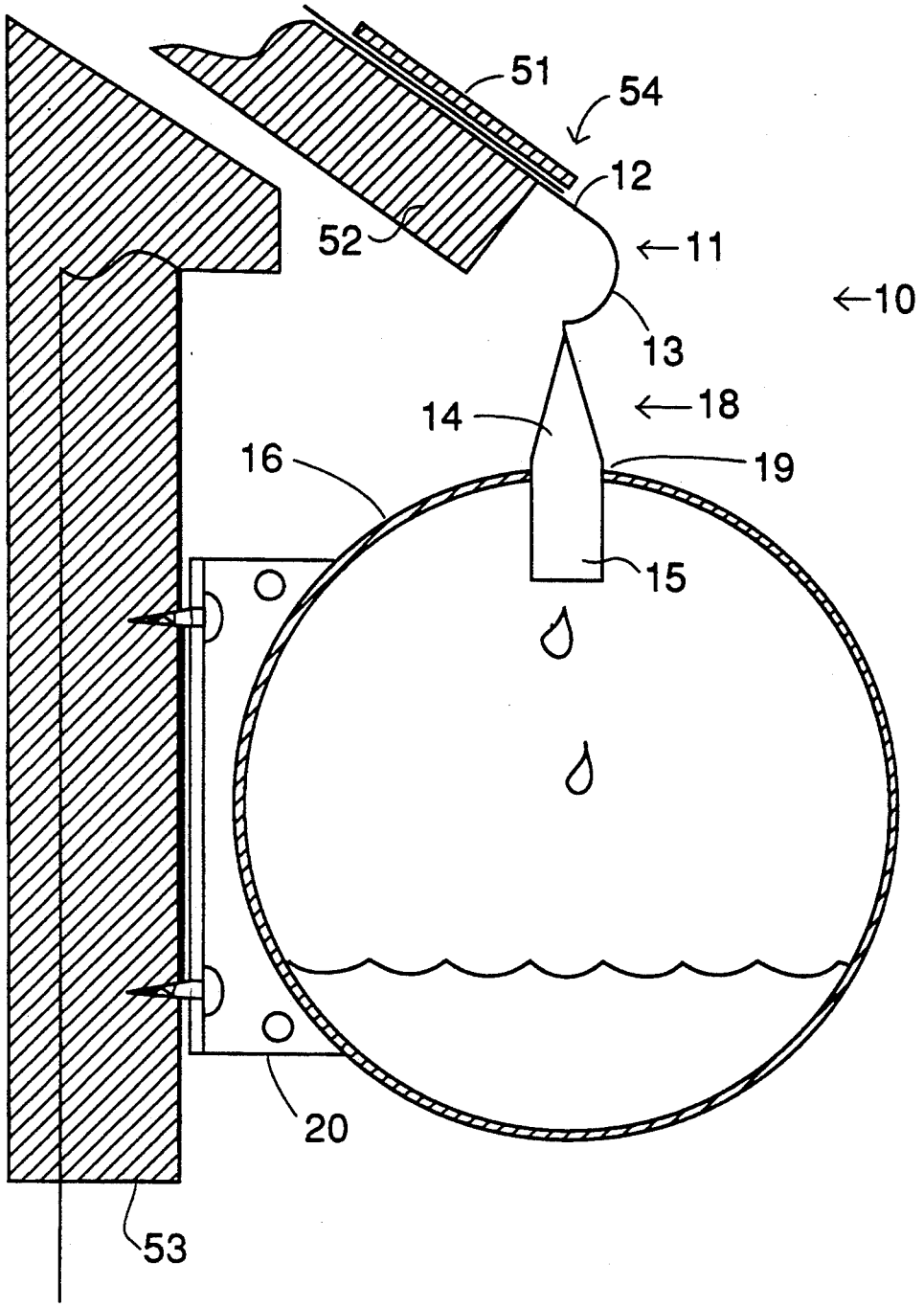
FIG. 2 is a cross sectional view taken on lines 2—2 of FIG. 1.

The first embodiment of the invention is disclosed in FIGS. 1 and 2. The conventional parts of the building are a roof sheathing 52 covered with shingles 51 and a facia board 53 below and behind the roof edge 54. The rain gutter 10 has three principal elements, a collector plate 11, a strainer 18 and a pipe 16.

A collector plate 11, having three sections, is attached to both the roof sheathing 52 and the pipe 16. The collector plate 11 has an upper flat section 12 which is attached between the roof sheathing 52 and the lower course of the shingles 51. The function of the flat section 12 is to collect the rain (and the debris), and to transmit them to the arcuate section 13. The arcuate section 13 begins at the angle of the roof line and goes beyond the vertical.

The function of the arcuate section 13 is to change the flow of water from the angle of the roof sheathing 52 to a vertical direction, and then an inwardly inclined direction. The water will remain on the arcuate section 13 beyond the vertical direction due to the effect of surface tension.

As the water passes around the vertical part of the arcuate section 13, the larger types of debris, such as leaves, will fall to the earth. This increases the effect of the arcuate section 13 in separating the larger types of debris from the water before they encounter the strainer 18, where they may tend to clog the strainer 18. Some portion smaller types of debris, such as pine needles, and catkins, will remain entrained with the water.

Attached to the lower edge of the arcuate section 13 is the down lead section 14. The function of the down lead section 14 is to accelerate the velocity of the water to ensure it passes through the strainer 18. In this embodiment, the down lead section 14 is itself part of the strainer 18. The lower portion of the down lead section 14 is cut into vertical strips 15 which are twisted in a spiral to a plane normal to the plane of the arcuate section 13.

Below the collector plate 11 is the horizontally extending pipe 16. The pipe 16 is attached to the facia board 53 with a conventional brackets 20. In the top of the pipe 16 is an opening 19 running the length of the pipe 16. The width of the opening 19 is just sufficient to receive the vertical strips 15. The lower ends of the vertical strips 15, which are parallel, and the opening 19, form the strainer 18 to separate the debris from the water entering the pipe 16.

The size of the openings of the strainer 18 are determined by the distance between the cuts forming the vertical strips 15. The cuts may be spaced from ¼ to ¾ inches apart, and preferably about ½ inches apart. The spacing should be just close enough to prevent all but the smallest fraction of debris from entering the pipe 16, but no closer than necessary, as close spacing allows the largest fraction of the debris, such as leaves to clog the openings and prevents the strainer 18 from allowing the water to enter the pipe 16. The size of the opening can vary with the diameter of the pipe, since larger pipe can pass more and larger debris without clogging. The size of the pipe will vary with the horizontal length of the roof, and to a lesser extent with the geographical location.

Figure 3:
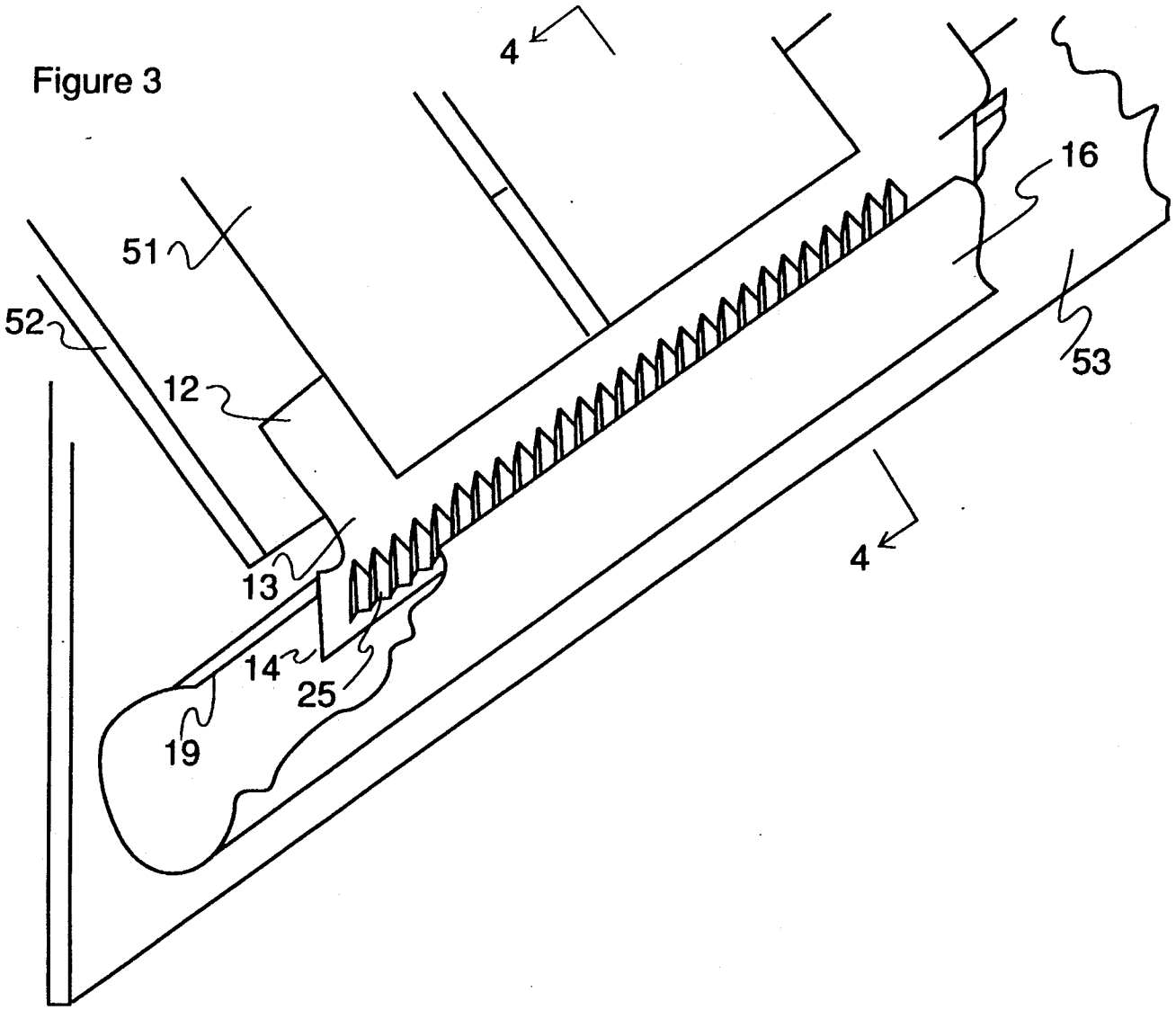
FIG. 3 is a perspective view of a second embodiment of my invention.
Figures 4, 5:
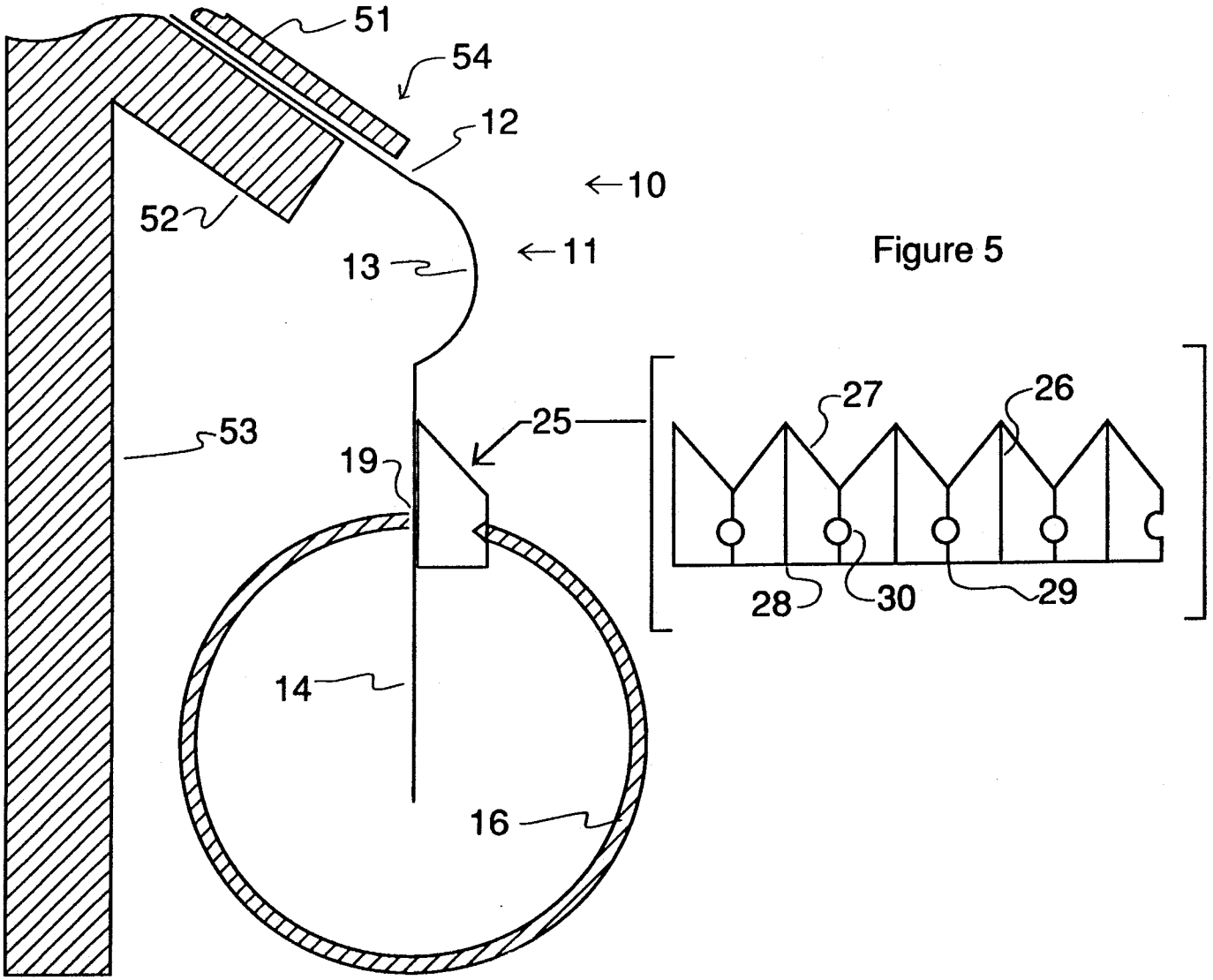
FIG. 4 is a cross sectional view taken on lines 4—4 of FIG. 3.
FIG. 5 is a partial front view of the strainer of FIG. 3.

The second embodiment of the invention is disclosed in FIGS. 3, 4 and 5. In this embodiment the flat section 12, the arcuate section 13 and the pipe 16 are the same as in the first embodiment. The down lead section 14 differs in not having any vertical strips 15. Attached to the front of the down lead section 14 is a pleated strainer 25 having symmetrical diagonal walls 26, each with a concave crease 28 at the surface of the down lead section 14. Each diagonal wall 26 has a diagonal upper surface 27 sloping downward from the concave crease 28. Each pair of diagonal walls 26 meet at a convex crease 29, which contains an aperture 30.

The pleated strainer 25 fits within the opening 19 of the pipe 16, and prevents debris flowing with the rain from entering the pipe 16. Any debris coming into contact with two adjacent diagonal upper surface 27 will be carried past the opening 19 and thus prevented from entering the pipe 16.

The size of the openings or mesh of the pleated strainer 25 is determined by the dimensions and geometry of the diagonal wall 26. Preferably the convex and the concave creases will be at about 30°, the width of the diagonal wall 26 will be about 1 inch and the height of the will be about ½ inch.

Figures 6, 7:
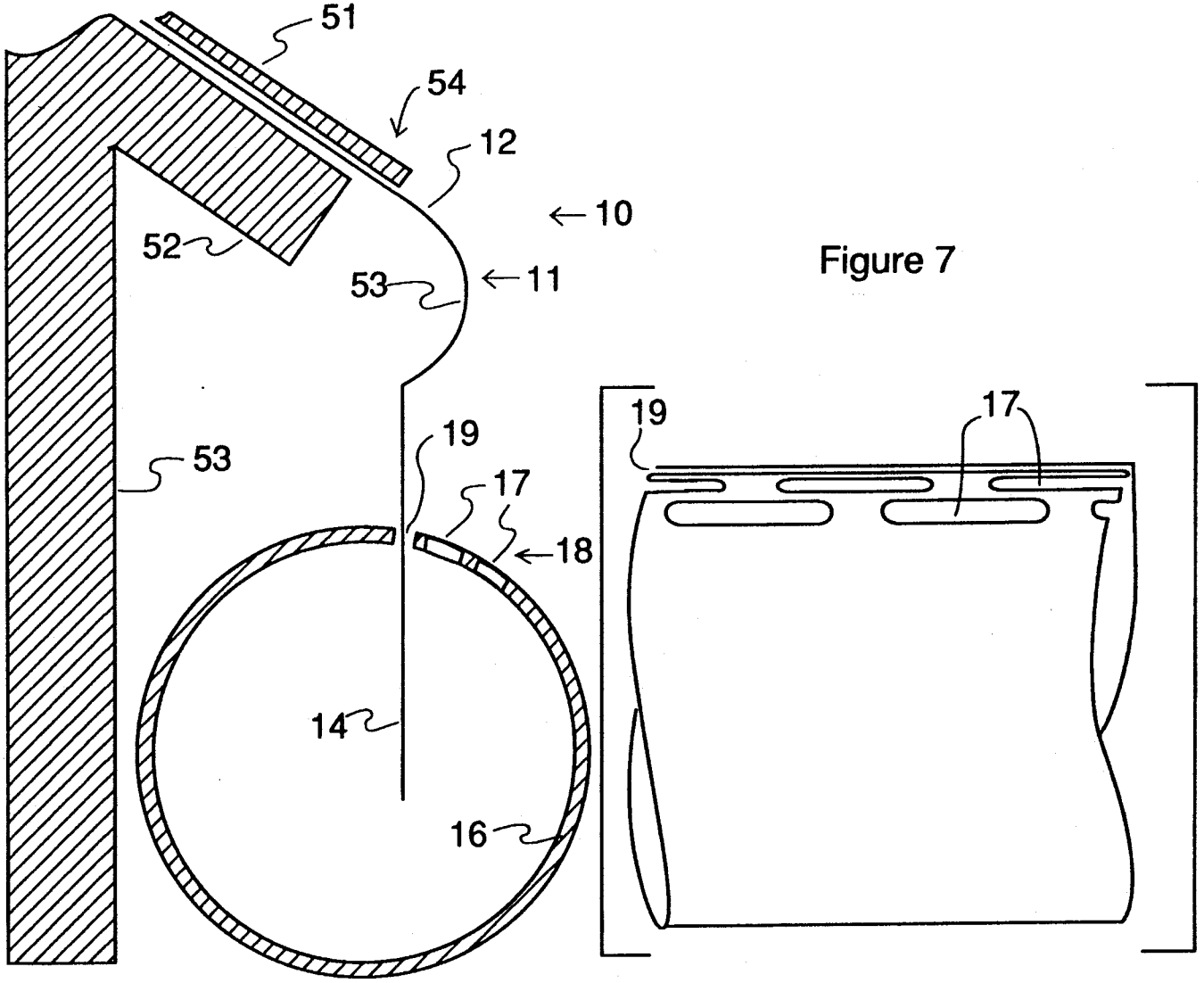
FIG. 6 is a cross sectional view of a third embodiment of the invention.
FIG. 7 is a partial side view of the pipe of this embodiment.

The third embodiment of this invention is shown in FIGS. 6 and 7. The flat section 12 and the arcuate section 13 are the same as in the other embodiments. The down lead section 14 has neither vertical strips 15 nor a pleated strainer 25 and therefore the width of the opening 19 in the pipe 16 need only be enough to receive the down lead section 14. The opening 19 may me made with a single cut the length of the pipe 16, and the down lead section 14 then fit into the opening 19 with a force fit, as neither water or debris should enter the pipe 16 at the opening 19.

The location of the opening 19, or the orientation of the pipe 16 places the opening 19 forward and below the highest point of the pipe 16. This has two advantages, the first of which is that the velocity of the water remains higher as the water passes over the pipe 16.

Below the opening 19 are a series of apetures 17 which form the strainer 18 of this embodiment. The water, and the debris not swept off at the arcuate section 13, leave the down lead section 14 at the juncture of the down lead section 14 and the opening 19, and flow across the surface of the pipe 16. As the water and the debris flow across an apeture 17 the water passes through the apeture 17, while the debris is swept past and falls to the ground. The second advantage of canting the opening 19 is that the apetures 17 are then on a more sloped surface and the debris is less likely to enter the pipe 16.

Water flowing over the surface of a pipe 16 tends to form in rivulets. Therefore a preferable form of apetures 17 is two or more rows of elongated apetures 17, of ¼ inch wide and 1 to 2 inches long. This construction places a apeture 17 below every rivulet, wherever located.

The rain gutter disclosed here is adaptable to a wide variety of roof configurations and climatic conditions. Differences in either roof pitch, or the distances between the eaves and facia are easily accommodated within relatively wide ranges.

In different types of buildings, the pitch of roof sheathing range from 5° to 60°. The collector plate accommodates to this 55° variation by flexing the joint between the flat section and the arcuate section, and by expanding the arcuate section. The location of the pipe under the eaves and next to the facia board will place the opening of the pipe in a range of positions relative to the roof edge. The collector plate accommodates to this range by having the flat section at different positions under the first course of shingles and the down lead section at different depths in the pipe.

The size of the pipe will vary depending on the size of the roof and to some degree the climatic conditions. A substantially smaller size is needed than is conventional if the pipe remains unclogged by debris, which is the principal purpose of this invention. The size of the pipe may be varied widely without any change in the size of the collector plate or the pleated strainer, if used.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A rain gutter for mounting under a building's roof edge comprising in combination:

a) a collector plate, a strainer and a separate pipe;

b) said collector plate having a first flat section fitting between the roof sheathing and the shingles;

c) said collector plate having a second arcuate section extending from the lower edge of the flat section to the vertical and past the vertical inwardly toward the building;

d) said collector plate having a third down lead section extending from the lower edge of the arcuate section;

e) the down lead section having vertical strips at the lower portion of the down lead section, said vertical strips twisted to end at a position normal to the upper portion of the down lead section, said twisted strips of a length sufficient to allow the pipe to assume a slight angle to the horizontal;

f) said pipe extending generally horizontally with a slight angle toward the downspout along and below the roof edge and having an opening to receive the lower portion of the vertical strips; and, g) said strainer formed by the intersection of the down lead section and the pipe;

Whereby the rain exiting the roof is transferred to the collector plate, is then led into a vertical path by the arcuate section, is accelerated by the down lead section, and the debris which is entrained with the rain is separated by the strainer, preventing the debris from entering the pipe.

2. The combination of claim 1 including a down lead section having vertical strips of from about ¼ to ¾ inches in width.

3. The combination of claim 1 including a down lead section having vertical strips of about ½ inches in width.

4. A rain gutter for mounting under a building's roof edge comprising in combination:

a) a collector plate, a pleated strainer and a separate pipe having an opening running the length of the pipe;

b) said collector plate having a first flat section fitting between the roof sheathing and the shingles;

c) said collector plate having a second arcuate section extending from the lower edge of the flat section to the vertical and past the vertical inwardly toward the building;

d) said collector plate having a third down lead section extending from the lower edge of the arcuate section, said down lead section of a length sufficient to allow the pipe to assume a slight angle to the horizontal;

e) said pleated strainer in front of the down lead section and in the opening of the pipe and said pleated strainer having a plurality of diagonal walls, each with a concave crease with the adjacent wall, said concave crease against a down lead section; and, f) said pipe extending generally horizontally with a slight angle toward the downspout along the roof edge;

Whereby the rain exiting the roof is transferred to the collector plate, is then led into a vertical path by the arcuate section, is accelerated by the down lead section, and the debris which is entrained with the rain is separated by the strainer, preventing the debris from entering the pipe.

5. The combination of claim 4 including the concave creases between adjacent diagonal walls having angle of about 30°.

6. A rain gutter for mounting under a building's roof edge comprising in combination:

a) a collector plate, a strainer and a separate pipe;

b) said collector plate having a first flat section fitting between the roof sheathing and the shingles;

c) said collector plate having a second arcuate section extending from the lower edge of the flat section to the vertical and past the vertical inwardly toward the building;

d) said collector plate having a third down lead section extending from the lower edge of the arcuate section, said down lead section of a length sufficient to allow the pipe to assume a slight angle to the horizontal;

e) the down lead section extending through an opening in the pipe;

f) said strainer formed of apertures in the pipe below the intersection of down lead section and the pipe; and, g) said pipe extending generally horizontally with a slight angle toward the downspout along the roof edge;

Whereby the rain exiting the roof is transferred to the collector plate, is then led into a vertical path by the arcuate section, is accelerated by the down lead section, and the debris which is entrained with the rain is separated by the strainer, preventing the debris from entering the pipe.

7. The combination of claim 6 including apertures having a dimension of about ¼ inch in width and about 1 to 2 inches in length.

* * * * *